US008099814B1

(12) United States Patent
Harwerth et al.

(10) Patent No.: US 8,099,814 B1
(45) Date of Patent: Jan. 24, 2012

(54) DEVICE FOR CLEANING AND SCRUBBING

(75) Inventors: Randy L Harwerth, Olathe, KS (US); Bernard Harwerth, Olathe, KS (US)

(73) Assignee: Tube Scooter, LLC, Lee's Summit, MO (US)

( * ) Notice: Subject to any disclaimer, the term of this patent is extended or adjusted under 35 U.S.C. 154(b) by 413 days.

(21) Appl. No.: 12/397,682

(22) Filed: Mar. 4, 2009

Related U.S. Application Data

(60) Provisional application No. 61/034,517, filed on Mar. 7, 2008.

(51) Int. Cl.
*A46B 13/00* (2006.01)
*A47L 11/00* (2006.01)

(52) U.S. Cl. ..... 15/21.1; 15/4; 15/38

(58) Field of Classification Search ..... 15/4, 21.1, 15/38

See application file for complete search history.

(56) References Cited

U.S. PATENT DOCUMENTS

| | | | | |
|---|---|---|---|---|
| 1,238,641 | A | 8/1917 | Coon | |
| 1,542,025 | A | 11/1923 | Ballman | |
| 2,354,898 | A | 12/1942 | Wiksten | |
| 2,519,259 | A | 2/1945 | Liebman | |
| 2,724,848 | A | 4/1953 | Horvath | |
| 3,112,505 | A | 12/1963 | Hirst | |
| 3,648,315 | A * | 3/1972 | Hash | 15/4 |
| 3,925,908 | A | 12/1975 | Dunn | |
| 4,018,240 | A | 4/1977 | Palthe | |
| 4,912,797 | A * | 4/1990 | Brackett | 15/38 |
| 5,185,938 | A | 2/1993 | Hutt | |
| 5,213,121 | A | 5/1993 | O'Brien | |
| 6,666,925 | B2 * | 12/2003 | Brackett et al. | 134/6 |
| 7,200,891 | B1 | 4/2007 | McCulloch et al. | |
| 2002/0152568 | A1 | 10/2002 | Dillenger | |
| 2005/0087531 | A1 * | 4/2005 | Schutz | 220/23.87 |
| 2006/0060221 | A1 | 3/2006 | Beaver | |
| 2006/0260081 | A1 | 11/2006 | Frassinelli et al. | |

* cited by examiner

*Primary Examiner* — Joseph J Hail
*Assistant Examiner* — Shantese McDonald
(74) *Attorney, Agent, or Firm* — David E. Herron, II

(57) ABSTRACT

The disclosure details a device for cleaning and scrubbing that has a tub and a cylindrical brush rotatably mounted within its interior. The tub has a bottom, side walls, a front wall, back wall, and an open top. The device also includes a cover positioned within the tub; the cover has a shroud portion positioned over at least a portion of the brush as well as a generally planar portion that extends from the shroud to a location adjacent the bottom of the tub. The inventive device is well-suited for cleaning and scrubbing tools and implements that may be commonly used in the construction and/or remodeling industry.

18 Claims, 3 Drawing Sheets

DEVICE FOR CLEANING AND SCRUBBING

BACKGROUND OF THE INVENTION

The invention is well-suited as a device for cleaning and scrubbing tools and other items that may become soiled. The anticipated best mode of use for the inventive device is to scrub and clean tools and other items that may be used in the construction industry, making and manufacturing of fiberglass, or remodeling industry, such as spackling tools, chisels, rollers, putty applicators, paintbrushes or the like.

SUMMARY OF THE INVENTION

The invention is a device for cleaning and scrubbing that has a tub and a cylindrical brush rotatably mounted within its interior. The tub has a bottom, side walls, a front wall, back wall, and an open top. The device also includes a cover positioned within the tub; the cover has a shroud portion positioned over at least a portion of the brush as well as a generally planar portion that extends from the shroud to a location adjacent the bottom of the tub. The shroud has an open end facing the back wall of the tub, enabling at least a portion of an item to contact the cylindrical brush through the open end.

In a preferred embodiment, the shroud and planar portion comprise a unitary, monolithic, one-piece structure. Preferably, the brush is rotatably mounted to at least one of the side walls of the tub. The invention may include a block positioned between an end of the brush and a side wall of the tub. In this embodiment, the brush is rotatably mounted to the block affixed to the side wall rather than directly to the side wall of the tub.

The invention may also include a motor (or other torque-imparting means) for rotating the brush within the tub. In a preferred embodiment, the invention includes a shelf extending laterally outward from a position exterior the first wall of the tub, and the motor is then coupled to the shelf and configured to impart rotating torque to the brush. In this preferred embodiment, the motor is positioned outside the tub but bears a shaft that passes through an opening in the side wall of the tub to engage the brush within an interior of the tub.

The motor may be coupled directly to the wall of the tub, or it may be coupled to a shelf positioned adjacent and exterior the tub. In this embodiment, it is preferred that the invention includes a bracket for securing the motor to an underside of the shelf.

Other objects, advantages and novel features of the present invention will become apparent from the following detailed description of the invention when considered in conjunction with the accompanying drawing.

DETAILED DESCRIPTION OF THE PREFERRED EMBODIMENTS

Figure 1:
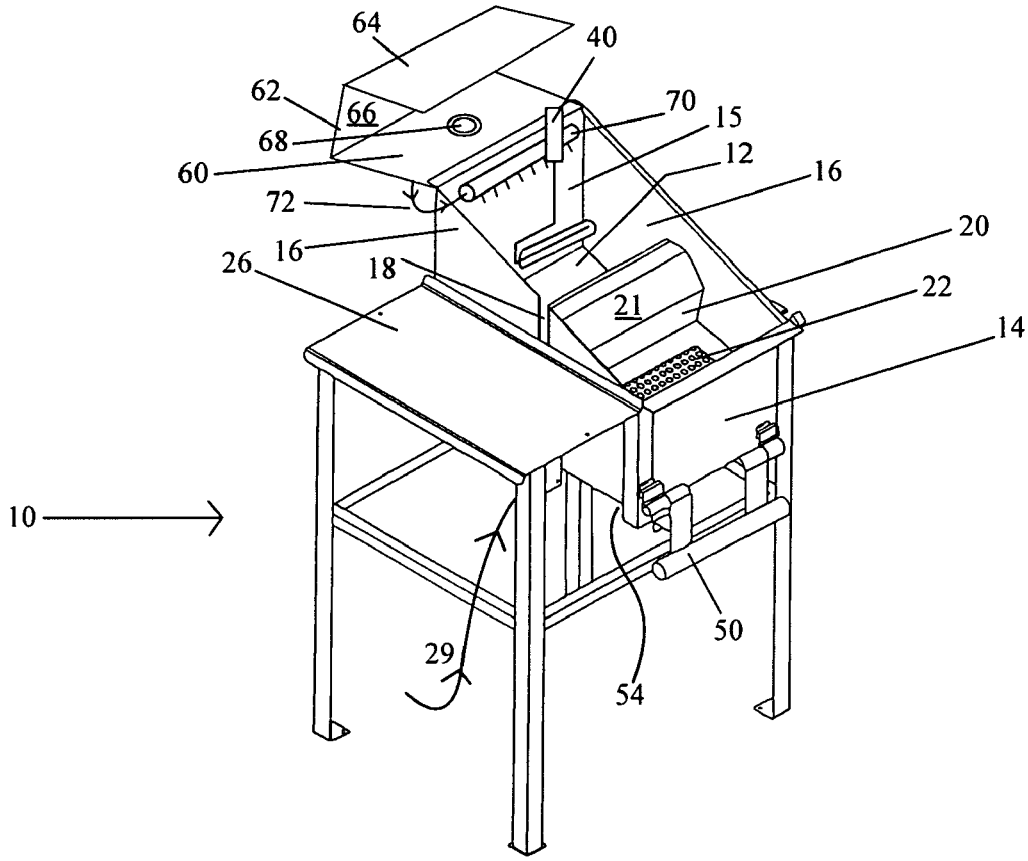
FIG. 1 is a perspective view of the inventive device, according to the principles of the invention.

FIG. 1 shows a perspective view of the fully-assembled device 10; which comprises a tub 12 having a front 14, a back 15, and side walls 16, 16'. A first sidewall 16 includes an opening 18 positioned approximately at a mid point of an interior portion of the tub 12. A cover 20 is positioned within an interior portion of the tub 12 and there is a shroud portion 21 positioned to extend over at least a portion of a brush 17 that is rotatably mounted beneath the cover 23.

As depicted in FIG. 1, the cover 20 also includes a planar portion 22 extending from the shroud 21 to a position adjacent the front wall 14 of the tub 12. An air motor 28 (see FIG. 2) configured to impart rotating torque to the brush 17 (see FIG. 2), thereby providing scrubbing action for items 40 to be inserted into the tub 12 behind the cover 20. In that regard, it is preferred that the cover 20 and shroud portion 21 be configured so as to allow at least a portion of the brush to be exposed, thereby enabling one to insert items 40 into a space between the cover 20 and back wall 15 of the tub 12.

As shown in FIG. 1, the motor 28 may be powered by pressurized air connected to the motor by a hose 29. Of course, alternative means (electric current or fuel driven) of imparting torque to the brush 17 are certainly within the scope of the invention. However, pressurized air seems preferred, as it is a clean and safe source of energy. The device 10 may also include a drying attachment as well. The drying attachment includes a top shelf 60 extending outwardly from the back 15 of the device 10. In this embodiment, a hood assembly 62 is attached by a hinge-type connection to a portion of the top shelf 60 so that the hood assembly 62 is rotatable about an axis through a lower edge. The hood assembly 62 includes a first portion 66 and a second portion 64 angled downwardly from the first portion. The drying assembly will also include an air source in communication with a blower 70 coupled adjacent to an upper portion of the back 15. An activating switch 68 is positioned on the top shelf 60 and is configured to selectively activate the air source and the blower 70.

Still referring to FIG. 1, the drying assembly is shown in an open, deactivated position (for illustrative purposes). However, in order to activate the blower 70, one pivots the hood assembly 62 downwardly toward a closed and activated position, thereby pressing the first portion 62 of the assembly 60 into contact with the activating switch 68, which in turn initiates airflow from the air source and through the blower 70. When in the closed and activated position, the second portion 64 of the assembly 60 extends over the blower 70 and into an interior portion of the tub 12, thereby protecting the operator from flying debris that may be dislodged as one air dries implements 40.

Still referring to FIG. 1, the tub 12 may be filled at least partially with a cleaning fluid, such as solvents for removing dirt and soil from used items 43. In that regard, the tub 12 bears a bottom tilted forward toward the front wall 14. In this embodiment, the tub 12 bears a hole (not shown in FIG. 1, viewable in FIG. 3) in communication with a hose 38 that allows the fluid to drain from the tub 12.

FIG. 1 further shows that a shelf 26 may be positioned laterally adjacent to the tub 12 and proximate first wall 16. In a preferred embodiment, the motor (not viewable in FIG. 1) is coupled to an underside of the shelf 26.

FIG. 1 also depicts an activating apparatus positioned on an outer portion of the front wall 14 of the device 10. The activating apparatus includes at least one (preferably two) arms rotatably hinged to and extending from the front wall 14 at a first end of the arm, and coupled to an activating bar 50 at adjacent a second end of each arm. A switch 54 is positioned on the front wall 14 as well. The switch is activated when a user presses against (i.e., with his/her leg) the bar, thereby engaging an arm into the switch 54, thereby activating the air source, and in turn imparting rotating torque to the brush 17 (shown aft).

Figure 2:
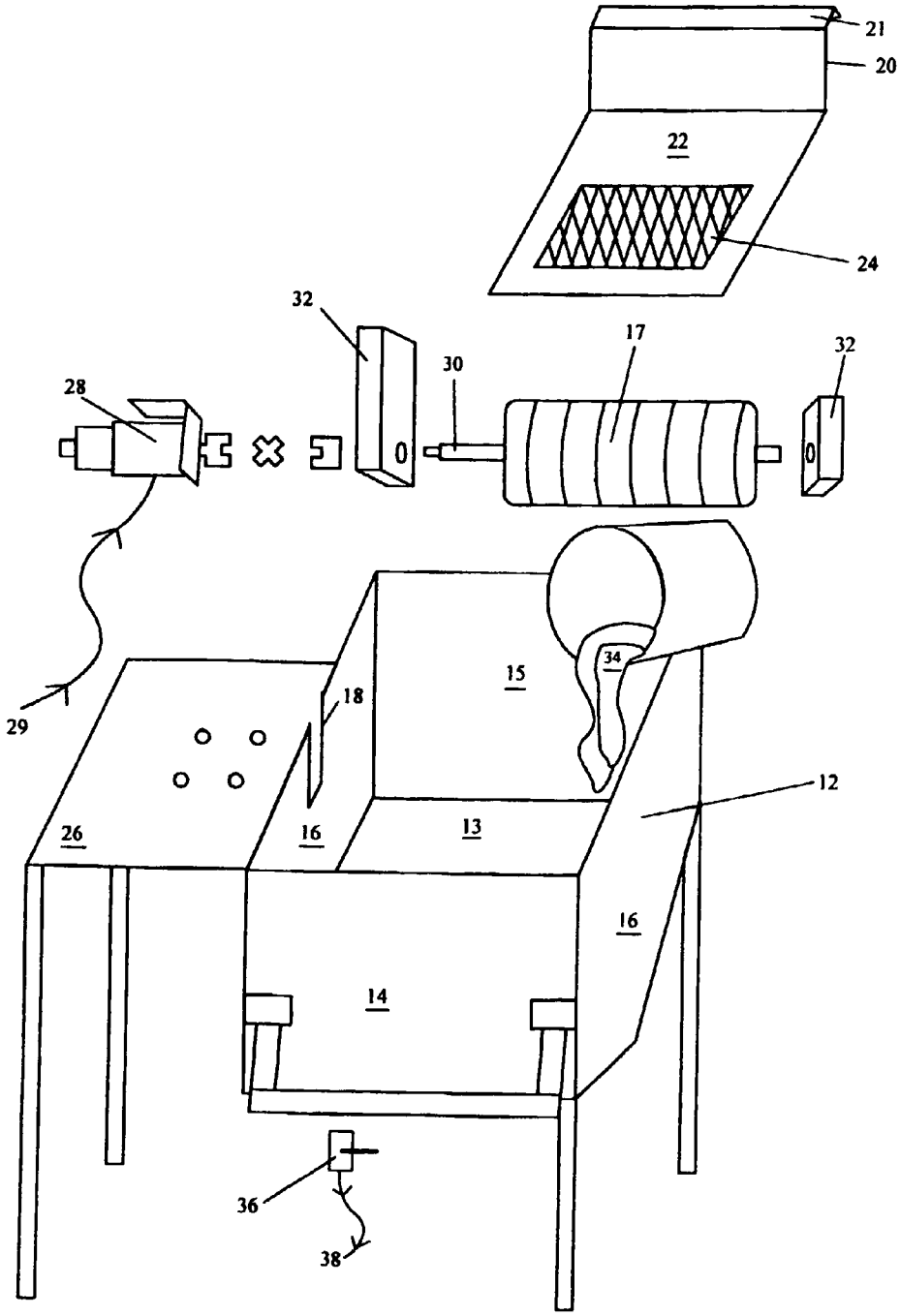
FIG. 2 shows an exploded, perspective view detailing the first preferred embodiment of the inventive device.
Figure 3:
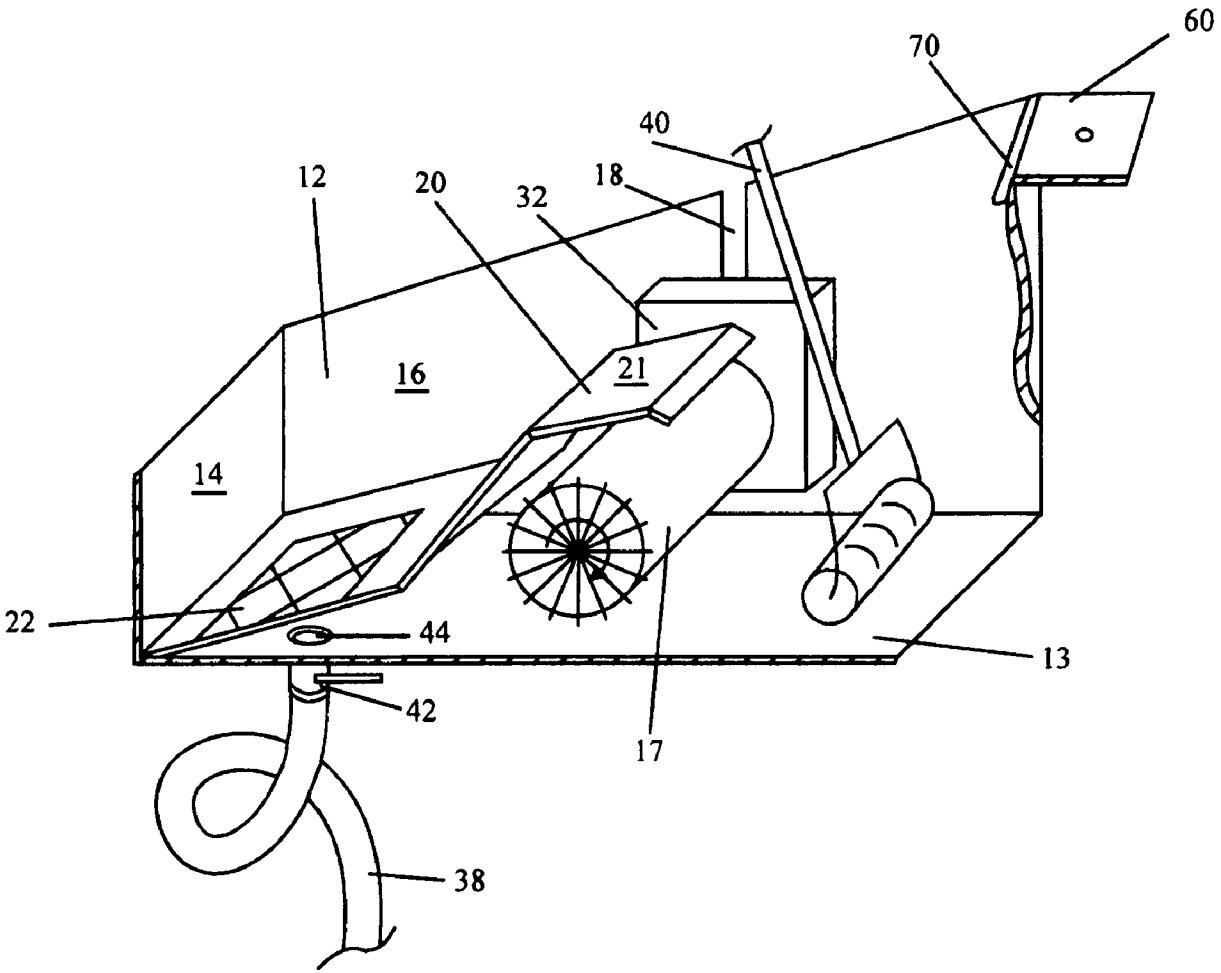
FIG. 3 is an isolated, perspective view showing a cross-section of the tub portion of the invention.

FIG. 2 is an exploded, perspective view detailing the various parts of the inventive device 10. The device 10 includes a tub 12 having a bottom 13, a front wall 14, a back wall 15, and side walls 16, 16'. A brush 17 is positioned within an interior of the tub and configured to be rotatably mounted beneath a cover 20 having a shroud 21 that extends over at least a portion of the brush 17 when it is in the mounted position (as shown in FIGS. 1, 3). In this embodiment, a torque imparting means, such as a motor 28 is positioned exterior the tub 12 and just outside the first side wall 16.

As shown in FIG. 2, the motor 28 bears a shaft 30 passing through an opening 18 in side wall 16 to engage the brush 17. A block 32 may be coupled to an interior surface of the first wall 16 in order to provide additional stability. In this embodiment, the block 32 is bolted to the inner wall 16 of the tub 12, and bears an aperture or peg for coupling to the brush 17.

Still referring to FIG. 2, the device 10 can also include a shelf 26 positioned exterior of the tub 12. In this embodiment, a bracket mounts the motor 28 to an underside of the shelf 26. Of course, the motor 28 may also bear a bracket enabling one to affix the motor to outer wall 16 of the tub 12.

As shown in FIG. 2, the cover 20 includes a shroud 21 and a generally planar portion 22 extending from the shroud portion 21. In a preferred embodiment, the cover 20 comprises a unitary, monolithic, one-piece structure. The device 10 may also include a cleaning fluid 34 within the interior of the tub 12. Because the device 10 is well suited to clean and scrub a variety of items and tools, the fluid 34 should be chosen as a cleaner, solvent, thinner, or any appropriate fluid well suited for the type soil that must be removed or scrubbed away from the item.

As depicted in FIG. 2, the planar portion of the cover 20 bears a grating 24 that allows fluid 34 to pass therethrough during the cleaning process. Preferably, the fluid 34 bears a depth within tub 12 that would enable ends of the scrubbed items to be inserted into the fluid and simultaneously maintain contact with at least a portion of the brush 17.

Still referring to FIG. 2, the device 10 will also include a hose 38 attached to a hole in the bottom 13 of the tub 12, and positioned adjacent the front wall 14 of the tub 12. The device 10 may also include valve 36, such as a ball-type valve (or the like) interior of the tub 12 and configured to allow one to drain fluid from the tub 12.

It is important to note, at this point, that the exploded view of FIG. 2 does not include depictions of the drying apparatus attached to the back wall 15 that was shown and discussed above, nor does FIG. 2 depict the activation means attached to the front wall 14. These aspects were omitted from FIG. 2 for the purpose of clarity and brevity only; it is to be understood that these aspects of the device 10 are important options for any embodiment of the device.

FIG. 3 shows an isolated, perspective, and cross-sectional view of an interior portion of the tub 12. As shown, the brush 17 is mounted sidewall 16 through block 32 affixed to side wall 16. As shown in FIG. 3, the cover 20 bears a shroud 21 that extends over at least a portion of the brush 17. As shown, the shroud 21 and brush 17 are configured such that at least a portion of the brush 17 extends outwardly to enable tools 40 to contact the rotating brush 17. The cover 20 also includes a planar portion 22 that extends from the shroud 21 to engage the tub 12 adjacent its front 14 and the bottom 13. The planar portion 22 if the cover 20 also bears a grating 24 that enables cleaning solvents and fluids to pass freely there through.

As shown in FIG. 3, the bottom 13 of the tub 12 bears a hole 44 enabling cleaning solvent and fluid to drain from an interior portion of the tub 12. In that regard, a valve 42 such as ball-type valve is coupled to an underside of the bottom 13 of the tub 12 at its position adjacent the hole 44 enabling one to selectively drain fluid from an interior portion of the tub 12. Of course, a hose 38 maybe positioned and coupled to the valve to lead to a drain or receptacle for retaining or disposing of the used cleaning fluid.

Still referring to FIG. 3, the device 10 is well suited to clean and scrub items 40 such as rollers, paint brushes, chisels, or spackling tools. Of course, the scrubbing action imparted by the device 10 is well suited for any number of applications.

Although the present invention has been described and illustrated in detail, it is to be clearly understood that same is by way of illustration and example only, and is not to be taken by way of limitation. The spirit and scope of the present invention are to be limited only by the terms of the appended claims which precisely define the metes and bounds of the invention.

We claim:

1. A device for cleaning and scrubbing an item, the device comprising:

a tub having a bottom, a front wall, a back wall, side walls and an open top;

a cylindrical brush rotatably mounted within an interior of the tub;

a cover positioned within an interior of the tub, the cover including a shroud positioned over at least a portion of the brush; and, a generally planar portion having a first edge that extends from a location adjacent the bottom of the tub and a second edge coupled to the to the shroud;

wherein, the shroud is configured with an open end facing the back wall of the tub, enabling at least a portion of the item to contact the cylindrical brush through the open end.

2. The device as in claim 1, wherein the shroud and planar portion comprise a cover that is a unitary, monolithic, one-piece structure.

3. The device as in claim 2, wherein the brush is rotatably mounted to the block that is coupled to the side wall.

4. The device as in claim 2, further comprising a motor configured to rotate a shaft that is coupled to the brush; wherein, a terminus of the shaft engages the brush inside the tub and the motor is positioned outside the tub, and the shaft passes through an opening in the first side wall of the tub.

5. The device as in claim 4, further comprising a shelf positioned exterior and adjacent the first wall of the tub; and wherein the motor is coupled to the shelf.

6. The device as in claim 1, further including a block positioned between an end of the brush and a side wall of the tub.

7. The device as in claim 1, further including a shelf extending laterally outward from a position exterior the first wall of the tub; and, a motor coupled to the shelf and configured to impart rotating torque to the brush.

8. The device as in claim 1, further comprising a means for imparting rotating torque to the rod.

9. The device as in claim 1, further comprising a motor configured to rotate the brush.

10. The device as in claim 9, wherein the motor is a pneumatic motor.

11. A device for scrubbing an item, the device comprising:

a tub having a bottom, a front wall, a back wall, first and second opposed side walls and an open top;

a cylindrical brush rotatably mounted within an interior of the tub and extending from the first side wall to the second side wall;

a shroud positioned over at least a portion of the brush, the shroud having a portion that extends over at least a portion of the brush and a planar portion having an edge that engages the tub, the shroud also configured with an open end facing the back wall of the tub and allowing access to an exposed portion of the brush, thereby enabling at least a portion of the item to contact the cylindrical brush through the open end;

the planar portion of the shroud having a grating that enables fluid to pass through; and, a motor configured to rotate the brush.

12. The device as in claim 11, further including first block coupled to the first wall, and a second block coupled to the second wall; wherein, the brush is rotatably mounted adjacent the first block at its first end and mounted adjacent the second block at its second end.

13. The device as in claim 11, further comprising cleaning liquid within the tub.

14. The device as in claim 11, further including a shelf extending laterally outward from a position exterior the first wall of the tub; and wherein, the motor is coupled to the shelf and configured to impart rotating torque to the brush.

15. The device as in claim 14, further comprising an opening in the first wall of the tub; and, a shaft passing through the opening to engage the brush within the tub.

16. The device as in claim 11, further comprising a hole in the bottom of the tub and positioned near the front wall; and wherein, the bottom bears a forward tilt to guide liquid within the tub toward the hole in the front wall.

17. The device as in claim 16, further comprising a valve for selectively allowing liquid to drain from the hole.

18. A device for scrubbing an item, the device comprising:

a tub having a front wall, a back wall, first and second opposed side walls, a bottom tilted toward the front wall, and an open top;

a cylindrical brush rotatably mounted within an interior of the tub and extending from the first side wall to the second side wall;

cleaning liquid within the tub;

a cover having a shroud positioned over at least a portion of the brush and configured with an open end facing the back wall of the tub to allow access to an exposed portion of the brush, thereby enabling at least a portion of the item to contact the cylindrical brush through the open end; and, a planar portion extending from a shroud at a first edge and engaging the tub adjacent its bottom at a second edge, the planar portion bearing a grating that allows the cleaning liquid to pass therethrough;

a shelf extending laterally outward from a position exterior the first wall of the tub;

first block coupled to the first wall, and a second block coupled to the second wall;

a motor coupled to the shelf and configured to rotate a shaft that passes through aligned openings in the first wall and the first block to impart rotating torque to the brush, which is rotatably coupled within the tub adjacent the first block at its first end and adjacent the second block at its distal end;

a hole in the tub adjacent the front wall;

a ball valve for selectively allowing the cleaning fluid to drain from the hole in the tub.

* * * * *

UNITED STATES PATENT AND TRADEMARK OFFICE

CERTIFICATE OF CORRECTION

PATENT NO. : 8,099,814 B1
APPLICATION NO. : 12/397682
DATED : January 24, 2012
INVENTOR(S) : Randy L. Harwerth et al.

It is certified that error appears in the above-identified patent and that said Letters Patent is hereby corrected as shown below:

On the title page, item [73] the assignee of the entire right and interest in the above-noted patent is HAR-NOY METAL FABRICATORS, INC., of OLATHE, KANSAS 66061.

Signed and Sealed this
Fifth Day of February, 2013

Teresa Stanek Rea

Teresa Stanek Rea
*Acting Director of the United States Patent and Trademark Office*